US006087604A

United States Patent [19]

Suga et al.

[11] Patent Number: 6,087,604

[45] Date of Patent: Jul. 11, 2000

[54] THIN KEYBOARD

[75] Inventors: Seiichi Suga; Kazuhiro Yokoyama; Kazutoshi Watanabe; Tsuyoshi Narusawa; Shinji Hirano; Katsuyuki Katayama, all of Fukushima-ken, Japan

[73] Assignee: Alps Electric Co., Ltd., Tokyo, Japan

[21] Appl. No.: 09/442,219

[22] Filed: Nov. 17, 1999

[30] Foreign Application Priority Data

Nov. 26, 1998 [JP] Japan ..... 10-335108

[51] Int. Cl.[7] ..... H01H 13/70

[52] U.S. Cl. ..... 200/344

[58] Field of Search ..... 200/5 A, 517, 200/341, 344, 345; 400/490, 491, 491.2, 495, 495.1, 496

[56] References Cited

U.S. PATENT DOCUMENTS 5,280,147 1/1994 Mochizuki et al. ..... 200/344
5,488,210 1/1996 Shigetaka et al. ..... 200/344
5,597,067 1/1997 Yoneyama ..... 200/344
5,894,117 4/1999 Kamishima ..... 200/344
5,924,553 7/1999 Yeh ..... 200/344
6,004,051 12/1999 Hu ..... 400/491.2

*Primary Examiner*—Michael Friedhofer
*Attorney, Agent, or Firm*—Brinks Hofer Gilson & Lione

[57] ABSTRACT

A keyboard is constructed so that a ratio of a dimension between a first latching portion of a first lever and a pivotally supporting portion thereof to a dimension between this pivotally supporting portion thereof and a second latching portion thereof is equal to a ratio of a dimension between a first latching portion of a second lever and another pivotally supporting portion thereof to a dimension between this pivotally supporting portion thereof and a second latching portion thereof. Thus, when the key top descends, the second latching portions of the first and second levers are placed outside the first latching portions of the first and second levers. Consequently, reduction in thickness of a keyboard is achieved.

4 Claims, 6 Drawing Sheets

THIN KEYBOARD

BACKGROUND OF THE INVENTION

1. Field of the Invention

The present invention relates to a keyboard, which is used as and suited to an input device for word processors, personal computers and the like.

2. Description of the Related Art

A conventional keyboard used in such an input device has membrane switches that are placed on a support plate (not shown) made of metal. As illustrated in FIGS. 9 and 10, each of the membrane switches comprises a lower sheet 50, which has a stationary contact (not shown), and a flexible upper sheet 52 that has a movable contact (not shown) and that is arranged on this lower sheet 50 through an insulating spacer 51.

A support member 53 made of a resin material is arranged on each of the membrane switches. As viewed in each of these figures, two engaging portions 53*a*, each having an engaging hole 53*b*, are formed on the left-side portion of this support member 53, while two engaging portions 53*c*, each having an engaging hole 53*d*, are formed on the right-side portion thereof.

An opening 53*e* is formed among the left-side engaging portions 53*a* and the right-side engaging portions 53*c*.

Further, a first lever 54 made of a resin material has a pair of arm portions 54*c* and 54*d* each having cylindrical convex portions 54*a* and 54*b* respectively provided at both ends thereof. Moreover, a pivotally supporting portion 54*e* projecting outwardly is formed at the central portion of each of the arm portions 54*c* and 54*d*. Furthermore, each of the convex portions 54*b* is rotatably engaged with a corresponding one of the engaging portions 53*d* of the support member 53.

A second lever 55 made of a resin material is disposed outside the first lever 54. As viewed in FIG. 10, this second lever 55 comprises a connecting portion 55*a* provided at the right-side portion thereof, and a pair of arm portions 55*b*, which extend leftwardly upwardly and downwardly from the top and bottom portion of this connecting portion 55*a*, respectively. The second lever 55 is nearly U-shaped.

Cylindrical convex portions 55*c* are formed at both end portions of the connecting portion 55*a*, respectively, in such a manner as to protrude outwardly therefrom. A cylindrical convex portion 55*d* is formed at the left-side end portion of each of the pair of arm portions 55*b* in such a way as to project outwardly therefrom. A nearly elliptic recess portion 55*e* is formed at the central portion of each of the pair of arm portions 55*b*. Furthermore, each of the convex portions 55*d* is rotatably engaged with a corresponding one of the engaging portions 53*a* of the support member 53. Additionally, each of the pivotally supporting portions 54*e* of the first lever 54 is fitted into the corresponding recess portion 55*e*, so that the first and second levers 54 and 55 are combined with each other in such a manner as to intersect each other.

Further, a pair of holding portions 56*b* each having a sliding groove formed in such a way as to be outwardly opened are provided on the left-side portion of the back surface of a key top 56 made of a resin material, as viewed in these figures, in such a way as to face each other. Moreover, a pair of holding portions 56*d* each having a sliding groove formed in such a way as to be inwardly opened are provided on the right-side portion of the back surface of the key top 56, as viewed in these Figures, in such a way as to face each other.

As viewed in these figures, each of the protrusions 54*a* of the first lever 54 is slidably held in a corresponding one of the left-side holding portions 56*b*, while each of the protrusions 55*c* of the first lever 55 is slidably held in a corresponding one of the right-side holding portions 56*d*. Thus, the key top 56 is mounted on the first and second levers 54 and 55 in such a manner as to freely move up and down.

Furthermore, a dome-like elastic element 57 made of insulating rubber is put on the membrane switch by being placed in the opening 64*e* of the support member 53. The top end portion of the elastic element 57 abuts against the back surface of the key top 56.

The conventional keyboard is constituted by placing a plurality of sets of the first and second levers 54 and 55, the key top 56 mounted on these levers 54 and 55, and the elastic element 57 on the membrane switch in a plurality of lines.

Further, when the key top 56 is pushed, first, the convex portions 54*b* and 55*d* of the first and second levers 54 and 55 respectively rotate around the engaging portions 53*c* and 53*a* , each of which is used as a fulcrum, of the support member 53. Moreover, the pivotally supporting portion 54*e* of each of the first levers 54 moves in a corresponding one of the nearly elliptic recess portions 55*e*. Furthermore, while the convex portions 54*a* and 55*c* slide in the sliding grooves 56*b* and 56*d* provided at the side of the key top 56, respectively, the first and second levers 54 and 55 move down, so that the key top 56 descends.

This descent of the key top 56 results in the elastic element 57 being pushed. When the dome-like elastic element 57 is dented or reversed, a switch substrate 52 is pressed by a projection 57*a* provided in the elastic element 57. Thus, a circuit contact provided on the switch substrate 52 touches an electric conductor provided on an insulating substrate 50. Consequently, the membrane switch is turned on.

Subsequently, when the pressing of the key top 56 is stopped, the resilient force of the elastic element 57 causes the first and second levers 54 and 55 and the key top 56 to return to the positions taken by these elements before the key top 56 is pressed. Moreover, the switch substrate 52 pushed by the elastic element 57 returns to an initial state thereof by a restoring force thereof. Thus, the engagement between the switch substrate 52 and the insulating substrate 50 is canceled. Consequently, the membrane switch is brought into an off-state.

However, in the case of the conventional keyboard, when the key top 56 descends, the connecting portion 55*a* of the second lever 55 is placed on the right-side arm portion 54*d* of the first lever 55, as viewed in these Figures. Thus, the first and second-levers 54 and 55 overlap each other. Consequently, each of the first and second levers 54 and 55 cannot be put into a completely horizontal position. Therefore, the conventional keyboard has a problem in the reduction in thickness thereof.

Further, ascending and descending operations of the key top 56 are unstable because of the facts that the first and second levers 54 and 55 are rotatably engaged with the engaging portions 53*a* and 53*c* , respectively, and that the pivotally supporting portions 54*e* each serving as a fulcrum of the first and second levers 54 and 55 moves by sliding in the recess portion 55*e*. Thus, the conventional keyboard has another problem in the operability of the key top 56.

SUMMARY OF THE INVENTION

Accordingly, an object of the present invention is to provide a keyboard, which has a structure preventing the first and second levers 54 and 55 from overlapping each other even when the key top 56 descends, and which can be reduced in thickness and which excels in operability thereof.

To achieve the foregoing object, according to the present invention, there is provided a keyboard which comprises a key top held on a base plate in such a way as to freely ascend and descend, an elastic member for upwardly pressing the key top, and first and second levers for holding the key top so that the key top freely ascends and descends. In this keyboard, the first and second levers are combined with each other by pivotally supporting members, each of which is formed between first and second ends of a corresponding one of the first and second levers, in such a way as to intersect each other. The first lever has a first latching portion for catching the first end thereof on the base plate, and a second latching portion for catching the second end thereof on the key top. The second lever has a first latching portion for catching the second end thereof on the base plate, and a second latching portion for catching the first end thereof on the key top. The first catching portions of the first and second levers are caught on the base plate, and the second latching portions of the first and second levers are caught on the key top, so that the ratio of the dimension from the first latching portion of the first lever to the pivotally supporting member thereof to the dimension from the pivotally supporting member thereof to the second latching portion thereof is equal to the ratio of the dimension from the first latching portion of the second lever to the pivotally supporting member thereof to the dimension from the pivotally supporting member thereof to the second latching portion thereof. The second latching portions of the first and second levers are placed outside the first latching portions of said first and second levers when the key top descends.

Thus, each of the second latching portions of the first and second levers can be prevented from overlapping with a corresponding one of the first latching portions thereof when the key top descends. Moreover, the first and second levers can be rotated until each of these levers is in a nearly horizontal position.

Consequently, the height or dimension from the base plate to the key top can be reduced. Thus, a thin keyboard can be provided.

According to an embodiment of this keyboard of the present invention, the first latching portion provided at the first end of the first lever is rotatably caught on the base plate. The second latching portion provided at the first end of the second lever is rotatably caught on the key top. The second latching portion provided at the second end of the first lever is slidably caught on the key top. The first latching portion provided at the second end of the second lever is slidably caught on the base plate. The pivotally supporting members of the first and second levers are rotatably combined with each other.

Thus, the first and second levers can be moved smoothly upwardly and downwardly by using the combined rotatable pivotally supporting portions as a fulcrum. Moreover, the key top, which is in the nearly horizontal position, can smoothly ascend and descend. Consequently, the present invention can provide a keyboard having good operability.

According to another embodiment of the keyboard of the present invention, each of the first and second latching portions of the first and second levers is formed like a rod in such a way as to protrude therefrom. Further, a section of each of the first and second latching portions thereof has a nearly elliptic shape, whose dimension in an up-and-down direction is larger than a lateral dimension thereof.

Thus, the height or dimension from the base plate to the key top at the time of descending the key top can be reduced still more.

BRIEF DESCRIPTION OF THE DRAWINGS

Other features, objects and advantages of the present invention will become apparent from the following description of a preferred embodiment with reference to the drawings in which like reference characters designate like or corresponding parts throughout several views, and in which.

DESCRIPTION OF THE PREFERRED EMBODIMENT

Figure 1:
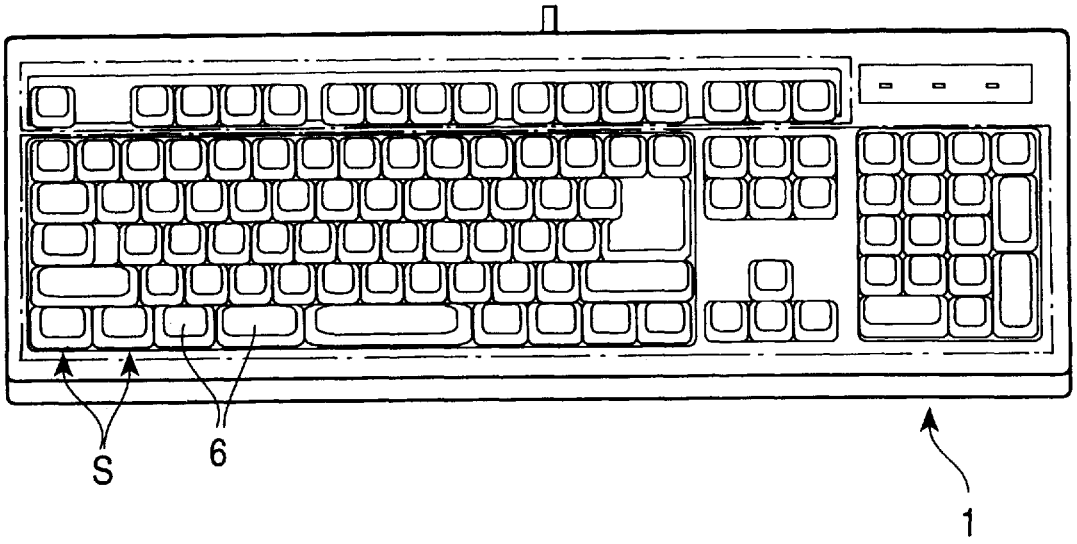
FIG. 1 is a plan view of a keyswitch according to the present invention.
Figure 2:
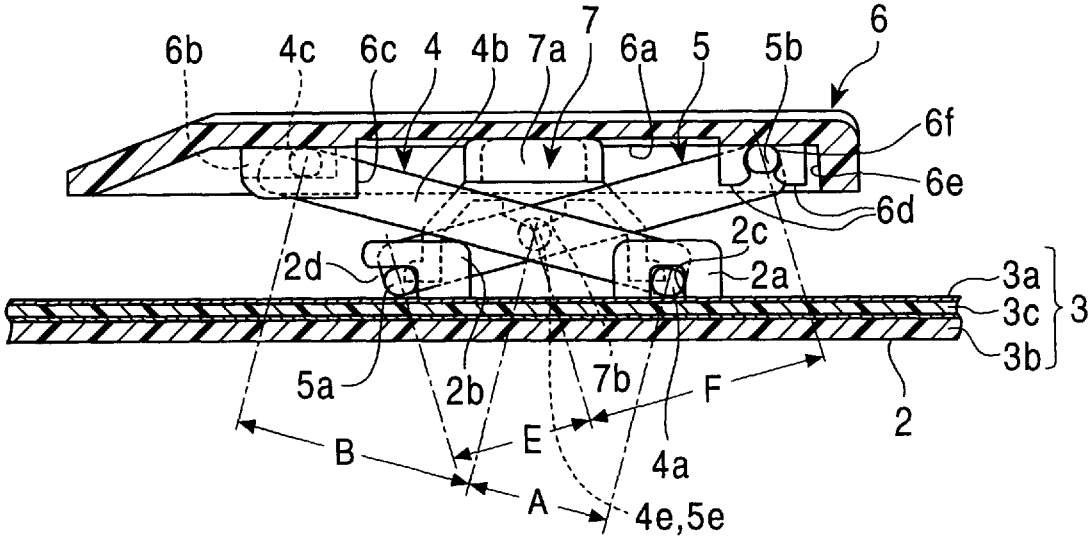
FIG. 2 is a sectional side view of a primary portion of the keyswitch according to the present invention.
Figure 3:
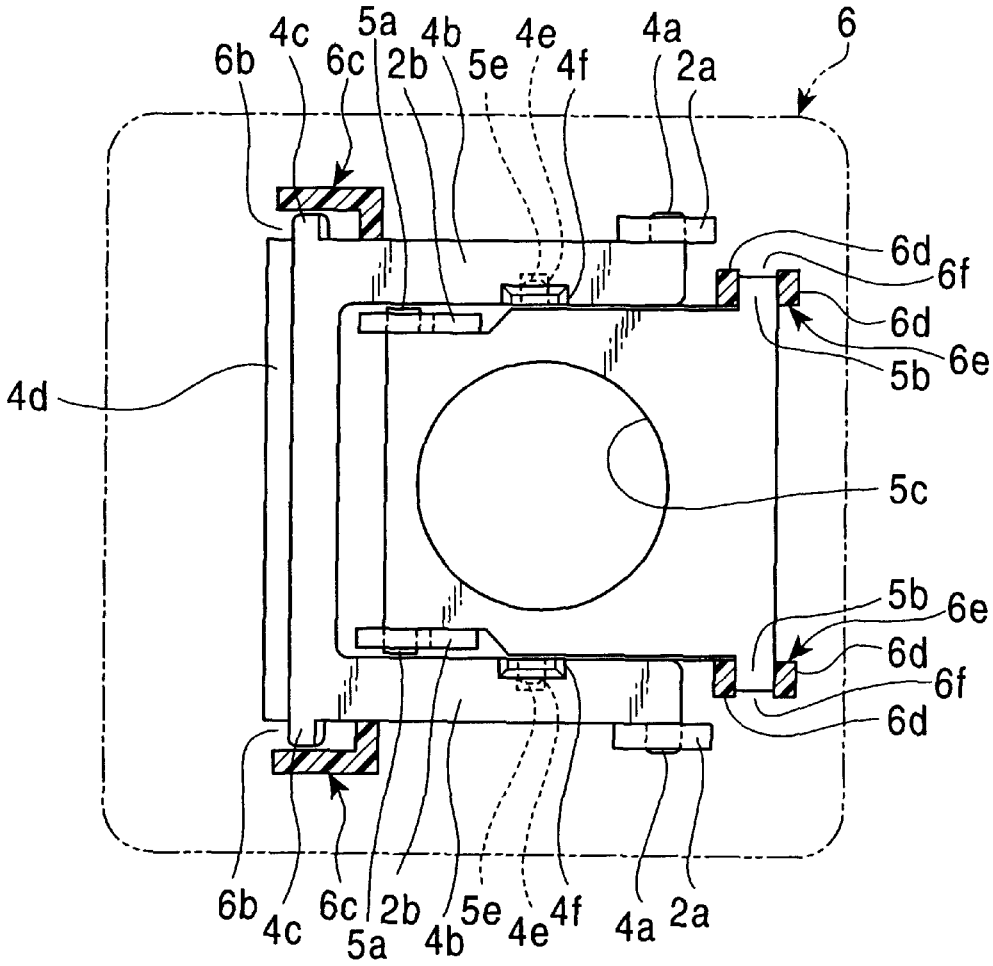
FIG. 3 is a sectional plan view of the primary portion of the keyswitch according to the present invention.
Figure 4:
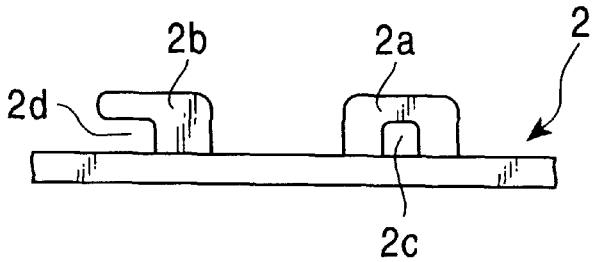
FIG. 4 is a partial side view of a base plate according to the present invention.
Figure 5A:
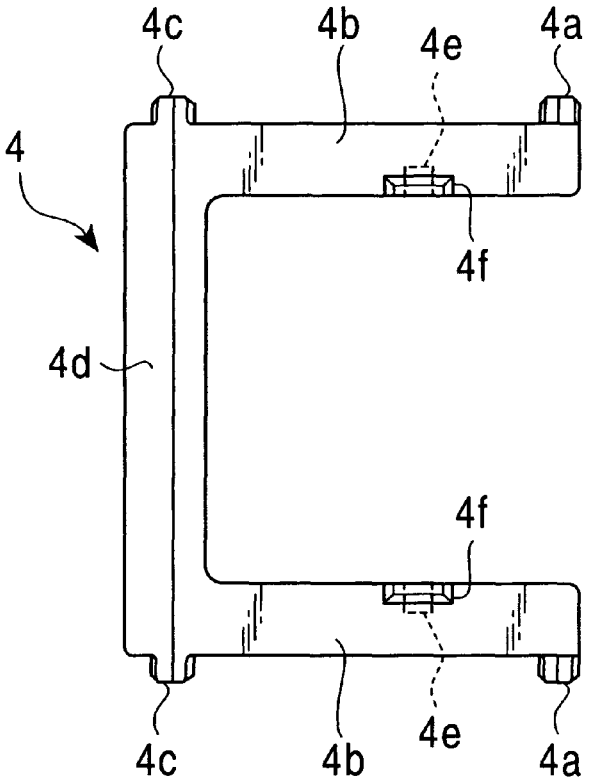
FIGS. 5A and 5B are plan and side views of a first lever according to the present invention, respectively.
Figure 5B:
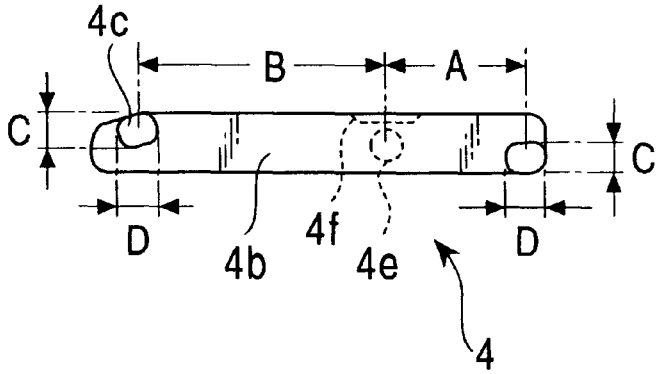
Figure 6A:
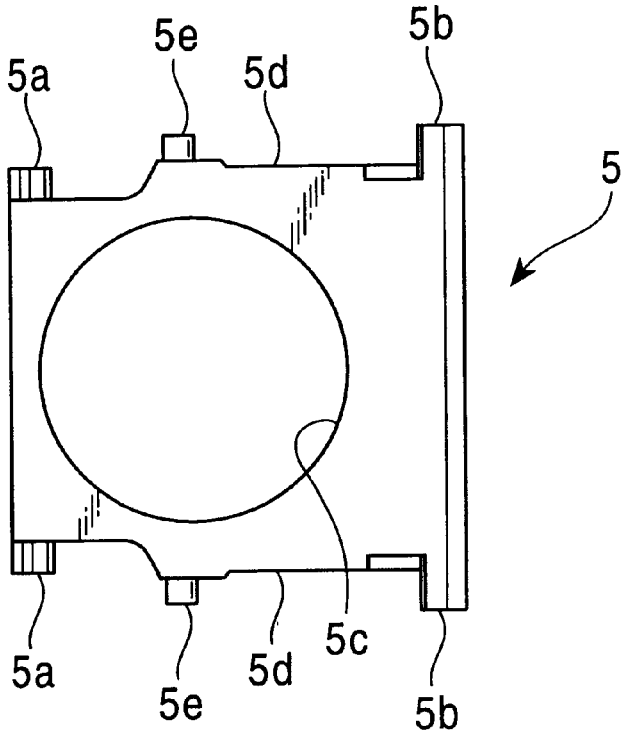
FIGS. 6A and 6B are plan and side views of a second lever according to the present invention, respectively.
Figure 6B:
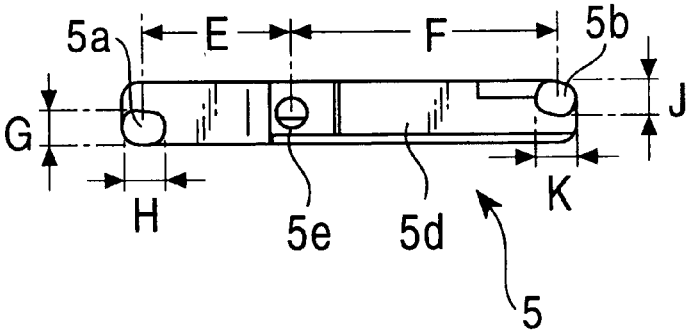
Figure 7:
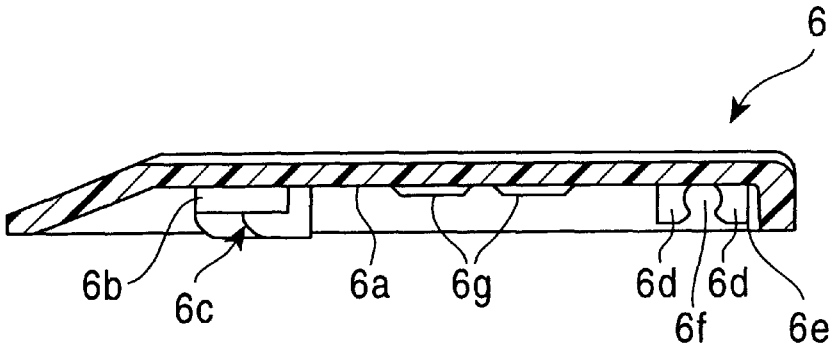
FIG. 7 is a sectional view of a primary portion of a key top according to the present invention.
Figure 8:
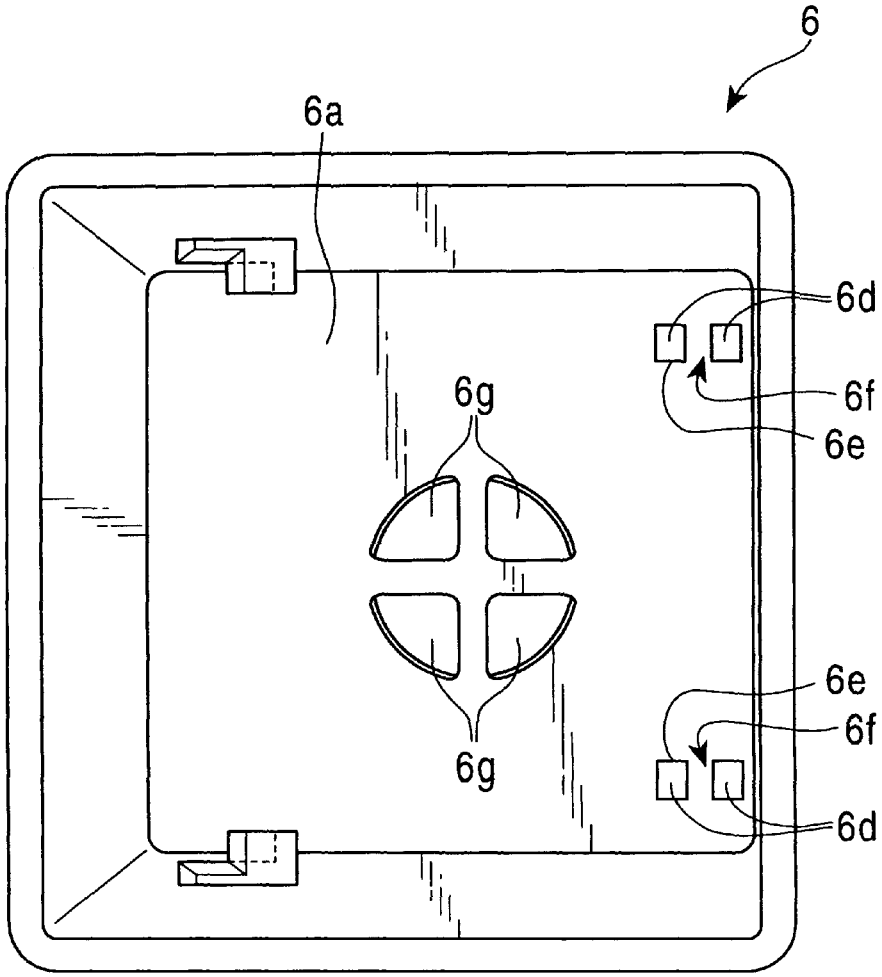
FIG. 8 is a bottom view of the key top according to the present invention.
Figure 9:
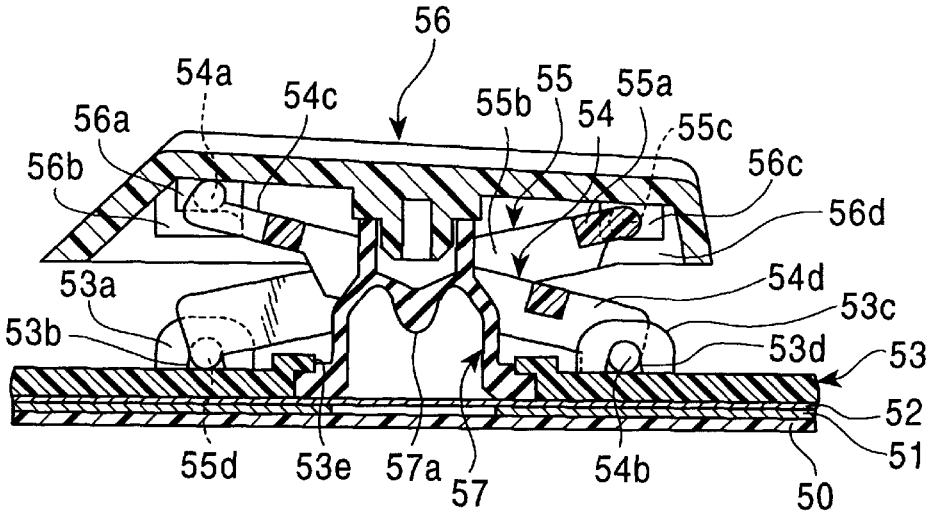
FIG. 9 PRIOR ART
FIG. 9 is a sectional side view of a keyswitch of a conventional keyboard.
Figure 10:
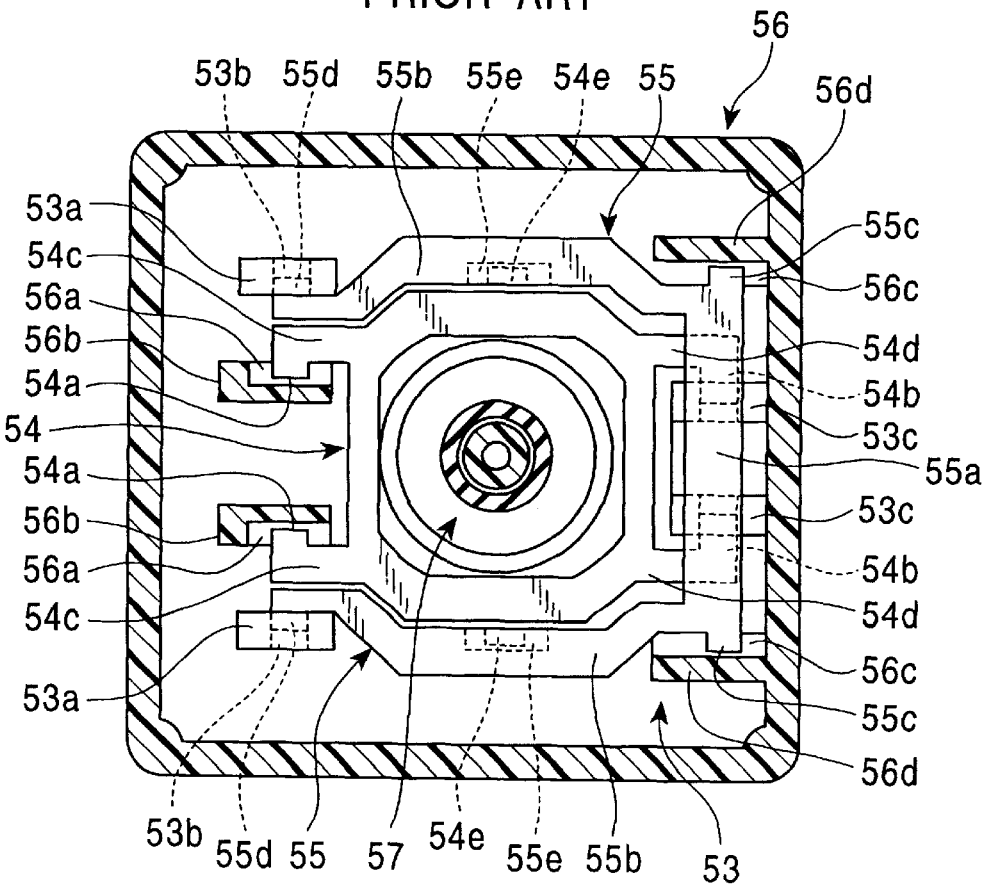
FIG. 10 PRIOR ART
FIG. 10 is a sectional plan view of the keyswitch of the conventional keyboard.

Hereinafter, the preferred embodiment of the present invention will be described in detail by referring to the accompanying drawings. FIG. 1 is a plan view of a keyswitch according to the present invention. FIG. 2 is a sectional side view of a primary portion of the keyswitch according to the present invention. FIG. 3 is a sectional plan view of the primary portion of the keyswitch according to the present invention. FIG. 4 is a partial side view of a base plate according to the present invention. FIGS. 5A and 5B are plan and side views of a first lever according to the present invention, respectively. FIGS. 6A and 6B are plan and side views of a second lever according to the present invention, respectively. FIG. 7 is a sectional view of a primary portion of a key top according to the present invention. FIG. 8 is a bottom view of the key top according to the present invention.

Referring first to FIG. 1, there is shown a keyboard of the present invention, in which plural keyswitches S are arranged in a casing 1. As shown in FIG. 2, a base plate 2 made of metal, such as aluminum, is disposed in the lower portion of the keyswitch S.

This base plate 2 has a first engaging portion 2*a* and a second engaging portion 2*b*, which are cut and raised by stamping, as shown in FIG. 4. The first engaging portion 2*a* is formed like a gate having a rectangular hole 2*c*. The second engaging portion 2*b* has a sliding groove 2*d*, whose one side is opened, and is L-shaped.

As illustrated in FIG. 3, the engaging portions 2*a* and 2*b* are formed so that a pair of the first engaging portions 2*a* face each other and that a pair of the second engaging portions 2*b* face each other.

A membrane switch 3 is put on the base plate 2. This membrane switch 3 is constructed by causing a movable contact (not shown), which is provided on the bottom surface of a flexible upper sheet 3*a*, to face a stationary contact (not shown) provided on the top surface of a lower sheet 3*b* and by causing a spacer 3*c* to intervene between the sheets 3*a* and 3*b*.

A hole (not shown), through which the first and second engaging portions 2*a* and 2*b* cut and raised from the base plate 2 can penetrate, is bored in each of the upper sheet 3*a*, the lower sheet 3*b* and the spacer 3*c* of the membrane switch 3. The first and second engaging portions 2*a* and 2*b* are inserted into this hole, so that the positioning of the membrane switch 3 is performed. Thus, the membrane switch 3 is placed on the base plate 2.

The first and second levers 4 and 5 are disposed on the membrane switch 3 positioned and placed on the base plate 2. Further, the first lever 4 rotatably engaged with the first engaging portion 2*a* is made of a resin material. As viewed in FIG. 5A, arm portions 4*b* and 4*b* respectively having first rod-like latching portions 4*a* and 4*a* projected upwardly and downwardly from the right-side ends thereof are formed in such a way as to face each other in the up-and-down direction.

Furthermore, the first lever 4 has a connecting portion 4*d*, which is provided at the left-side end, as viewed in this figure, and which connects the upper and lower arm portions 4*b* and 4*b*. Moreover, the rod-like second latching portions 4*c* and 4*c* are formed at the top and bottom ends of this connecting portion 4*d* in such a manner as to project therefrom. Further, the first lever 4 is opened at the right side thereof, as viewed in this figure. Thus, the first lever 4 is formed in such a way as to have a nearly U-shaped outward form.

As shown in FIG. 5B, each of the first and second latching portions 4*a* ad 4*b* is formed in such a way as to have a nearly elliptic section, whose dimension C in the up-and-down direction is larger than the lateral dimension D.

Such a first lever 4 is formed so that each of the first latching portions 4*a* is rotatably caught in the rectangular hole 2*c* of the first engaging portion 2*a*.

Each of circular-hole-like pivotally supporting portions 4*e* and 4*e* is formed to the corresponding first latching portion 4*a* provided on the inner surface of a corresponding one of the arm portions 4*b* and 4*b*, which face each other, in such a manner as to have a predetermined depth and a predetermined diameter. Further, guide portions 4*f* and 4*f* are formed by chamfering off the corner portions on these pivotally supporting portions 4*e* and 4*e*.

The first lever 4 is formed so that a part extending from the first latching portion 4*a* to the pivotally supporting portion 4*e* has the dimension A and that another part extending from the pivotally supporting portion 4*e* to the second latching portion 4*c* has the dimension B.

The second lever 5 slidably caught on the second engaging portion 2*b* of the base plate 2 is made of a resin material. Further, the second lever 5 is formed in such a way as to have a nearly rectangular outside shape, as illustrated in FIG. 6A. First rod-like latching portions 5*a* and 5*a* are respectively formed at the top and bottom ends of the left side of the second lever 5, as viewed in this figure, in such a manner as to protrude therefrom. Second rod-like latching portions 5*b* and 5*b* are respectively formed at the top and bottom ends of the right side of the second lever 5, as viewed in this figure, in such a way as to project therefrom.

As illustrated in FIG. 6B, the first latching portion 5*a* is formed in such a manner as to have a nearly elliptic shape, whose lateral dimension H is larger than the dimension in the up-and-down direction G. Moreover, the second latching portion 5*b* is formed in such a way as to have a nearly elliptic shape, whose lateral dimension K is larger than the dimension in the up-and-down direction J.

Further, the first latching portion 5*a* is slidably caught in the sliding groove 2*d* of the second engaging portion 2*b* of the base plate 2. A circular hole 5*c* for allowing an elastic member 7 (to be described later) to penetrate therethrough is formed to the left side of the surface of the second lever 5, as viewed in this figure.

Moreover, cylindrical pivotally supporting portions 5*e* and 5*e* are formed on the upper and lower side surfaces 5*d* and 5*d* of the second lever 5 to the first latching portions 5*a* in such a way as to have a predetermined dimension and to protrude therefrom.

The second lever 5 is formed so that a part extending from the first latching portion 5*a* to the pivotally supporting portion 5*e* has the dimension E and that another part extending from the pivotally supporting portion 5*e* to the second latching portion 5*b* has the dimension F.

Furthermore, the pivotally supporting portion 5*d* of the second lever 5 is fitted into the circular-hole-like pivotally supporting portion 4*e* of the first lever 4, so that the first and second levers 4 and 5 are combined with each other in such a way as to intersect each other, as shown in FIG. 2. Additionally, each of the first latching portions 4*a* of the first lever 4 is rotatably caught in the corresponding first engaging portion 2*a* of the base plate 2. Each of the first latching portions 5*a* of the second lever 5 is slidably caught in the corresponding second engaging portion 2*b* of the base plate 2. Thus, the second latching portions 4*c* and 5*b* of the first and second levers 4 and 5 can move upwardly and downwardly.

The key top 6 held by the first and second levers 4 and 5 is made of a resin material. As viewed in FIGS. 7 and 8, a pair of first engaging portions 6*c* are formed on the left-side portion of the back surface 6*a* of the key top 6. Sliding grooves 6*b* are formed in these first engaging portions 6*c* in such a way as to inwardly face each other.

Moreover, a pair of second engaging portions 6*e* having engaging walls 6*d* and 6*d* formed in such a manner as to laterally face each other and project therefrom, as shown in FIG. 7, are formed on the right-side portion of the rear surface 6*a* of the key top 6, as viewed in this figure. Engaging grooves 6*f* each having nearly circular sections are formed in the side portion, in which the engaging walls 6*d* and 6*d* face each other, of the second engaging portions 6*e*. Each of the engaging grooves 6*f* is opened downwardly, as viewed in this Figure, so that this opening has a predetermined width.

Further, as shown in FIG. 8, a circular cap-positioning portion 6*g* is formed in the nearly central portion of the back surface 6*a* in such a manner as to be partitioned into 4 subportions arranged in a cross-like manner and to project therefrom.

Furthermore, the first latching portion 4*a* provided on one end of the first lever 4 is rotatably caught on the base plate 2, while the second latching portion 5*a* provided on the corresponding one end of the second lever 5 is rotatably caught on the key top 6. Further, the first latching portion 4*a* provided on the other end of the first lever 4 is slidably caught on the key top 6, while the second latching portion 5*a* provided on the corresponding other end of the second lever 5 is slidably caught on the base plate 2. The pivotally supporting portions 4*e* and 5*e* of the first and second levers 4 and 5 are rotatably caught on the key top 6. Thus, the key top 6 is held by the first and second levers 4 and 5 in such a manner as to freely move upwardly and downwardly while the key top 6 is in a nearly horizontal position.

The elastic element 7 for upwardly and elastically pushing the key top 6 is put on and attached to the membrane switch 3 provided between the first and second engaging portions 2*a* and 2*b* on the base plate 2 by using a bonding agent. The elastic element 7 is constituted by an insulating rubber cap, and contains a dome-like cavity 7*a* in which a convex portion 7*b* projecting downwardly is formed. The top end portion 7*c* of the elastic element 7 is positioned at the cap-positioning portion 6*g* provided on the back surface 6*a* of the key top 6. The keyboard of the present invention is configured in the aforementioned manner.

An operation of the keyboard having the aforementioned configuration is described hereinbelow. When the key top 6 descends, each of the first and second levers 4 and 5 is brought into a nearly horizontal position. Moreover, the cavity 7*a* of the elastic element 7 is crushed, and the convex portion 7*b* provided therein descends. The upper sheet 3*a* is pressed by this convex portion 7*b*. As a result, the movable contact (not shown) formed on the upper sheet 3*a* is brought into contact with the stationary contact (not shown) formed on the lower sheet 3*b*. Consequently, the membrane switch 3 is turned on.

Subsequently, when the pressing of the key top 6 is canceled, the resilient force of the elastic element 7 causes the first and second levers 4 and 5 and the key top 6 to return to the position taken by these elements before the key top 6 is pressed. Moreover, the upper sheet 3*a* pressed by the convex portion 7*b* of the elastic element 7 returns to the initial state by the restoring force thereof. Thus, the upper sheet 3*a* is disengaged from the lower sheet 3*b*. Consequently, the membrane switch 3 is turned off.

In the first lever 4 of the keyboard of the present invention, the first latching portions 4*a* are rotatably caught on the base plate 2. Further, the second latching portions 4*c* are slidably caught on the key top 6. In the second lever 5, the first latching portions 5*a* are slidably caught on the base plate 2. Furthermore, the second latching portions 5*b* are rotatably pivotally supported on the key top 6. The first and second levers 4 and 5 are combined with each other by the first and second pivotally supporting portions 4*e* and 5*e* in such a manner as to intersect each other.

Thus, the first and second levers 4 and 5 can be turned upwardly and downwardly by using each of the pivotally supporting portions 4*e* and 5*e* as a fulcrum. The key top 6 can be held by the first and second levers 4 and 5 in such a way as to freely ascend and descend by simultaneously maintaining the nearly horizontal position thereof.

Although the preferred embodiment of the present invention has been described above, it should be understood that the present invention is not limited thereto and that other modifications will be apparent to those skilled in the art without departing from the sprint of the invention.

The scope of the present invention, therefore, should be determined solely by the appended claims.

What is claimed is:

1. A keyboard comprising:

a key top held on a base plate in such a way as to freely ascend and descend;

an elastic member for upwardly pressing said key top; and first and second levers for holding said key top so that said key top freely ascends and descends, wherein said first and second levers are combined with each other by pivotally supporting members, each of said pivotally supported members is formed between first and second ends of a corresponding one of said first and second levers, in such a way as to intersect each other, wherein said first lever has:

a first latching portion for catching said first end thereof on said base plate; and a second latching portion for engaging said second end thereof on said key top, wherein said second lever has:

a first latching portion for catching said second end thereof on said base plate; and a second latching portion for catching said first end thereof with said key top, wherein said first latching portions of said first and second levers are caught on said base plate, and said second latching portions of said first and second levers are caught on said key top, so that a ratio of a dimension from said first latching portion of said first lever to said pivotally supporting member thereof to a dimension from said pivotally supporting member thereof to said second latching portion thereof is equal to a ratio of a dimension from said first latching portion of said second lever to said pivotally supporting member thereof to a dimension from said pivotally supporting member thereof to said second latching portion thereof, and wherein said second latching portions of said first and second levers are placed outside said first latching portions of said first and second levers when said key top descends.

2. The keyboard according to claim 1, wherein said first latching portion provided at said first end of said first lever is rotatably caught on said base plate, wherein said second latching portion provided at said first end of said second lever is rotatably caught on said key top, wherein said second latching portion provided at said second end of said first lever is slidably caught on said key top, wherein said first latching portion provided at said second end of said second lever is slidably caught on said base plate, and wherein said pivotally supporting members of said first and second levers are rotatably combined with each other.

3. The keyboard according to claim 2, wherein each of said first and second latching portions of said first and second levers is formed like a rod in such a way as to protrude therefrom, and wherein a section of each of said first and second latching portions thereof has a nearly elliptic shape, whose dimension in an up-and-down direction is larger than a lateral dimension thereof.

4. The keyboard according to claim 1, wherein each of said first and second latching portions of said first and second levers is formed like a rod in such a way as to protrude therefrom, and wherein a section of each of said first and second latching portions thereof has a nearly elliptic shape, whose dimension in an up-and-down direction is larger than a lateral dimension thereof.

* * * * *

UNITED STATES PATENT AND TRADEMARK OFFICE

CERTIFICATE OF CORRECTION

PATENT NO. : 6,087,604
DATED : July 11, 2000
INVENTOR(S) : Seiichi Suga et al.

It is certified that error appears in the above-identified patent and that said Letters Patent is hereby corrected as shown below:

Claim 1,
Line 9, change "supported" to -- supporting --.

Signed and Sealed this

Twelfth Day of March, 2002

*Attest:*

*Attesting Officer*

JAMES E. ROGAN
*Director of the United States Patent and Trademark Office*